US010238944B1

(12) United States Patent
Turchyn et al.

(10) Patent No.: US 10,238,944 B1
(45) Date of Patent: Mar. 26, 2019

(54) BASKETBALL GOAL DOCK

(71) Applicant: Litania Sports Group, Inc., Champaign, IL (US)

(72) Inventors: James L. Turchyn, Urbana, IL (US); Gregory W. Luebbering, Heyworth, IL (US); Bryan R. Carrel, Urbana, IL (US); DeJazz L. Woods, Champaign, IL (US)

(73) Assignee: Litania Sports Group, Inc., Champaign, IL (US)

( * ) Notice: Subject to any disclaimer, the term of this patent is extended or adjusted under 35 U.S.C. 154(b) by 0 days.

(21) Appl. No.: 15/696,363

(22) Filed: Sep. 6, 2017

(51) Int. Cl.
*A63B 63/08* (2006.01)
*A63B 71/00* (2006.01)
*A63B 71/02* (2006.01)

(52) U.S. Cl.
CPC ..... *A63B 71/023* (2013.01); *A63B 63/083* (2013.01); *A63B 71/0054* (2013.01)

(58) Field of Classification Search
CPC . A63B 63/083; A63B 71/023; A63B 71/0054; A63B 2071/025; A63B 69/0071
See application file for complete search history.

(56) References Cited

U.S. PATENT DOCUMENTS 2,630,192 A * 3/1953 Stenhouse ..... B60T 3/00 188/32
3,245,181 A * 4/1966 Stephenson ..... E04F 11/1812 248/222.14
3,871,492 A * 3/1975 Garrett ..... B60T 3/00 188/32
3,973,651 A * 8/1976 Garrett ..... B60T 3/00 188/32
5,113,976 A * 5/1992 Noakes ..... B65H 49/38 188/32
5,469,804 A * 11/1995 Bracken ..... B63B 49/00 114/343
5,954,307 A * 9/1999 Williams ..... B60B 33/00 248/501
6,881,163 B2 4/2005 Schroeder et al.
7,260,906 B1 * 8/2007 Herbstritt ..... G09B 19/00 40/426
7,581,623 B1 * 9/2009 Egnor ..... B60T 3/00 188/32
8,002,230 B2 * 8/2011 Kempte ..... A47B 77/02 248/501
9,889,365 B2 * 2/2018 Gravel ..... A63B 71/0036
2008/0128220 A1 * 6/2008 Hartmann ..... B60T 3/00 188/32
2011/0098139 A1 * 4/2011 Query, Jr. ..... A63B 63/004 473/478
2012/0228452 A1 * 9/2012 Nally ..... F16B 2/22 248/225.21

* cited by examiner

*Primary Examiner* — Alvin A Hunter
*Assistant Examiner* — Amir A Klayman
(74) *Attorney, Agent, or Firm* — Philip L. Bateman

(57) ABSTRACT

A docking tray for receiving a basketball goal includes: (a) a base having a front, a rear, and two sides, the front being wider than the rear and the two sides narrowing from front to rear; (b) two side walls extending upwardly along the sides of the base; (c) a rear wall extending upwardly along the rear of the base, the base, side walls, and rear wall forming an enclosure for a rear wheel of a basketball goal; and (d) a retainer for engaging, orienting, and securing a base of a basketball goal.

14 Claims, 2 Drawing Sheets

BASKETBALL GOAL DOCK

FIELD OF THE INVENTION

This invention relates to games. More particularly, this invention relates to the game of basketball. Still more particularly, this invention relates to basketball goal assemblies.

BACKGROUND OF THE INVENTION

The game of basketball was invented by Dr. James Naismith in 1891 to provide off-season exercise for baseball and football players. Dr. Naismith climbed a ladder and hammered a bottomless peach basket to a balcony as the first basketball goal. The game of basketball rapidly gained popularity and is now one of the most widely played games in the United States and the rest of the world.

The bottomless peach basket nailed to a balcony has long since been replaced by a goal consisting of a backboard (also known as a backstop) and a rim. The goal typically also includes a net attached to the rim that provides a visual aid in shooting the basketball and slows the basketball as it passes through the rim. The goal is mounted so the top of the rim is the desired height above the floor of the basketball court. The standard height of the rim is ten feet.

Basketball goals located outside are typically mounted on a pole. Basketball goals located in gymnasiums are typically mounted onto a wall or suspended from above. Basketball goals located in large, multiple-use arenas are typically part of a movable structure. These basketball goals typically include a weighted base, a plurality of wheels, and an arm that supports the backboard. The arm typically has a lowered position for transport and storage and a raised position for playing. These goals are rolled into position in the lowered position and then anchored to the floor with straps or chains. The backboard is then raised into the playing position. Schroeder et al., U.S. Pat. No. 6,881,163, Apr. 19, 2003, discloses such a basketball goal.

Movable basketball goals must be precisely positioned on the basketball court. A common way of locating the goal is to place tape, pins, indentations, or the like on or into the floor as a guide. These guides do not completely orient the goal in position and do not facilitate precise positioning of the goal.

Accordingly, there is a demand for an improved apparatus for positioning a movable basketball goal on a basketball court.

SUMMARY OF THE INVENTION

The general object of this invention is to provide an improved apparatus for positioning a movable basketball goal on a basketball court. More particularly, there is a demand for such an apparatus that guarantees precise positioning of the goal, that orients and secures the goal in the desired position, and that is easily and quickly installed and removed.

We have invented a docking tray for receiving a basketball goal having a base with wheels. The docking tray comprises: (a) a base having a front, a rear, and two sides, the front being wider than the rear and the two sides narrowing from front to rear; (b) two side walls extending upwardly along the sides of the base; (c) a rear wall extending upwardly along the rear of the base, the rear wall in combination with the base and the two side walls forming an enclosure for a rear wheel of a basketball goal; and (d) a retainer for engaging, orienting, and securing a base of a basketball goal.

We have also invented an improved basketball goal assembly. The assembly comprises a movable basketball goal and two docking trays for receiving and securing the basketball goal. The basketball goal comprises: (i) a backboard having a front and a rear; (ii) a rim connected to the front of the backboard; (iii) an arm connected to the rear of the backboard for elevating the backboard; (iv) a weighted base connected to the arm; and (v) two rear wheels for supporting the base. Each docking tray comprises: (i) a base having a front, a rear, and two sides, the front being wider than the rear and the two sides narrowing from front to rear; (ii) two side walls extending upwardly along the sides of the base; (iii) a rear wall extending upwardly along the rear of the base, the rear wall in combination with the base and the two side walls forming an enclosure for a rear wheel of a basketball goal; and (iv) a retainer for engaging, orienting, and securing the basketball goal.

The docking tray of this invention guarantees precise positioning of the basketball goal, orients and secures the goal in the desired position, and is easily and quickly installed and removed.

DETAILED DESCRIPTION OF THE INVENTION

Figure 1:
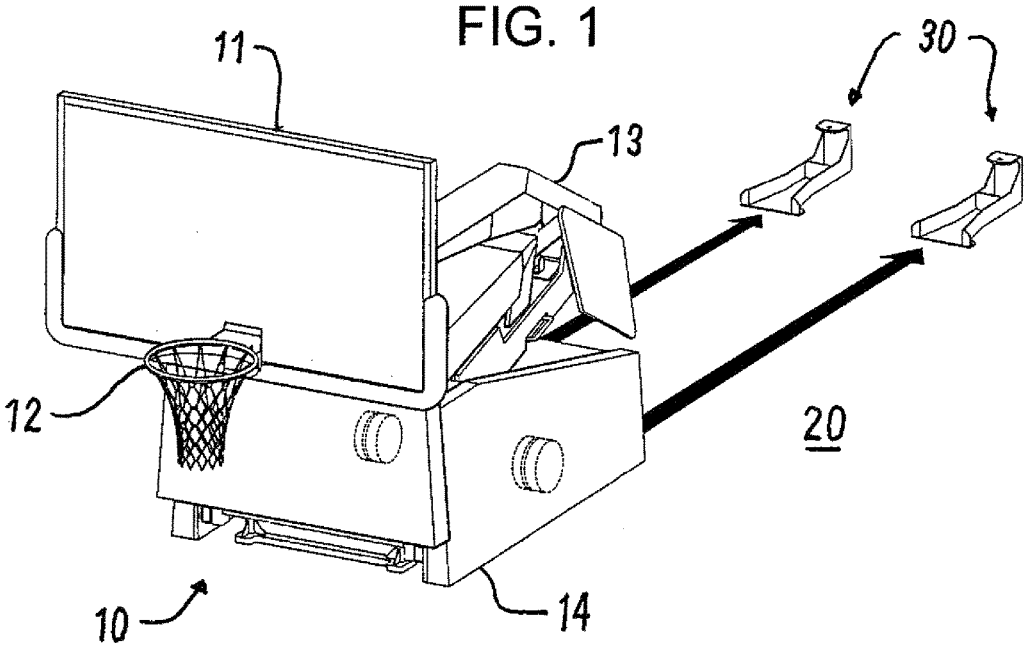
FIG. 1 is a front perspective view of a basketball goal being moved toward two docking trays.

This invention is best understood by reference to the drawings. Referring first to FIG. 1, a movable basketball goal 10 is quickly and easily moved in the desired position on a basketball court 20 by rolling its rear wheels into two docking trays 30 that have previously been installed on the court. The black arrows indicate the direction of movement of the basketball goal toward the docking trays. After the basketball goal wheels are in the docking trays, the goal is retained in position. The invention is discussed in more detail below.

The basketball goal is conventional. The goal comprises a backboard 11, a rim 12 connected to the front of the backboard, an arm 13 connected to the rear of the backboard for elevating the backboard and rim, a weighted base 14 connected to the arm, and four sets of casters for supporting the base. Goals typically have two sets of swiveling front casters and two sets of rigid rear casters. Each caster comprises one or more wheels. The term "wheel" is used herein to include a caster that swivels, a rigid caster that does not swivel, and other wheel structures. In FIG. 1, the arm is shown in its lowered position and the hidden rear wheels 15 are shown in broken lines. The goal is moved with its arm in the lowered position. The arm is raised after the goal is in place on the basketball court. As explained in more detail below, the base of the goal has a lower horizontal rear bar 14*a* running transversely (parallel to the backboard) a short distance above the rear wheels. The term "rear bar" is used herein to include any component at the rear of the base that fits within a retainer in the docking trays as described below.

Figure 2:
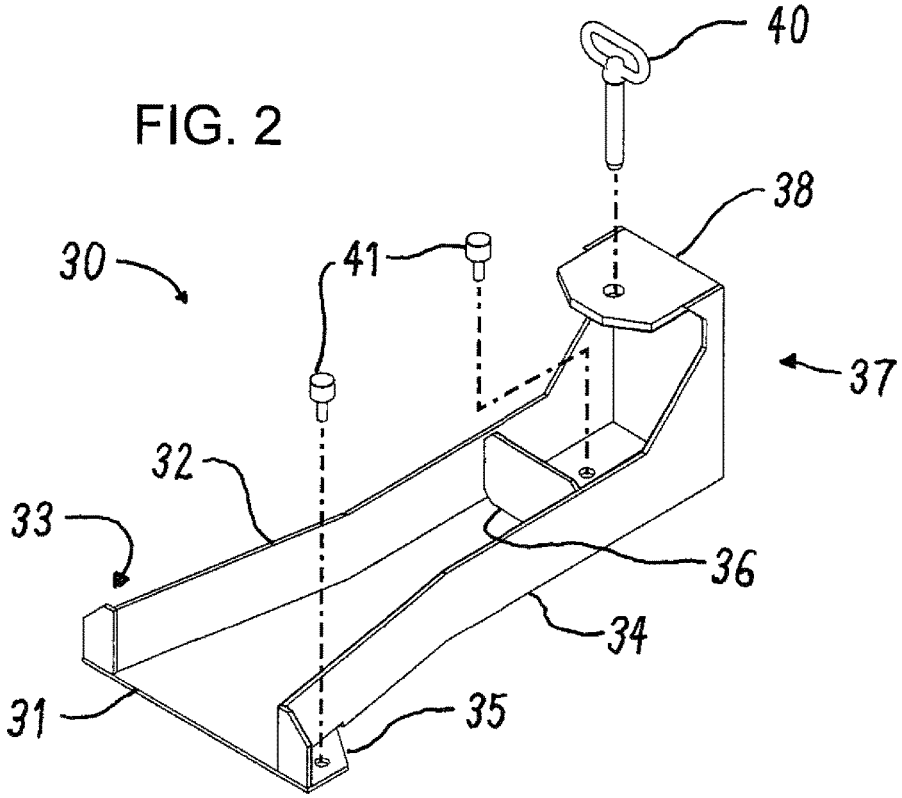
FIG. 2 is a front perspective view of a docking tray.

Referring now to FIG. 2, a preferred embodiment of the docking tray of this invention comprises a base 31, a left side wall 32, a left flange 33, a right side wall 34, a right flange 35, a rear wall 36, and a retainer 37 having an overhanging ledge 38. The base has a front, a rear, a left side, and a right side. The front is wider than the rear. In other words, the two sides narrow from front to back. The side walls extend upwardly along the sides of the base. The flanges extend outwardly and are located near the front, just outside the side walls. Each flange contains a hole for insertion of a thumbscrew or other fastener. The rear wall extends upwardly along the rear of the base. The base, side walls, and rear walls form an enclosure for a rear wheel of the basketball goal. The wider front makes it easier for the wheel to enter. The narrower rear orients the wheel in exactly the desired spot.

The retainer secures the goal after its rear wheels are oriented in position in the enclosures of the docking trays. In the preferred embodiment, the retainer is formed by an overhanging ledge that is supported by three walls elevating from an extension of the base. In the preferred embodiment, the base of the retainer includes a hole for insertion of a thumbscrew or other fastener. The overhanging ledge of the retainer contains a hole for insertion of a drop pin 40 or other fastener. The overhanging ledge and drop pin provide a fast and easy retention structure. However, other retention structures, including clips, chains, straps, and the like are also suitable.

The docking trays are locked into position on the basketball court by inserting thumbscrews 41 or other fasteners through the holes in the flanges and the hole in the retainer and into inserts (not shown) or other receivers that are installed into the floor of the basketball court. The fasteners and receivers are preferably threaded so the attachments of the docking trays to the court resist upward movement. The fasteners preferably can be installed without tools.

Each docking tray is typically made of a strong and durable material. The preferred material is steel. The size of the docking tray is a matter of choice that depends on the size and configuration of the basketball goal. The docking tray is generally about 12 to 36 inches, preferably about 20 to 28 inches, in length; generally about 6 to 12 inches, preferably about 7 to 10 inches, in width at the front; and generally about 3 to 9 inches, preferably about 4 to 7 inches, in width at the rear. The width of the docking at its front is generally about one and one-half to three times the width at its rear. The height of the side walls is generally about 1 to 5 inches, preferably about 2 to 4 inches. The height of the retainer portion is generally about 4 to 12 inches, preferably about 6 to 10 inches. The configuration of the retainer is determined by the configuration of the lower, rear portion of the goal.

Figure 3:
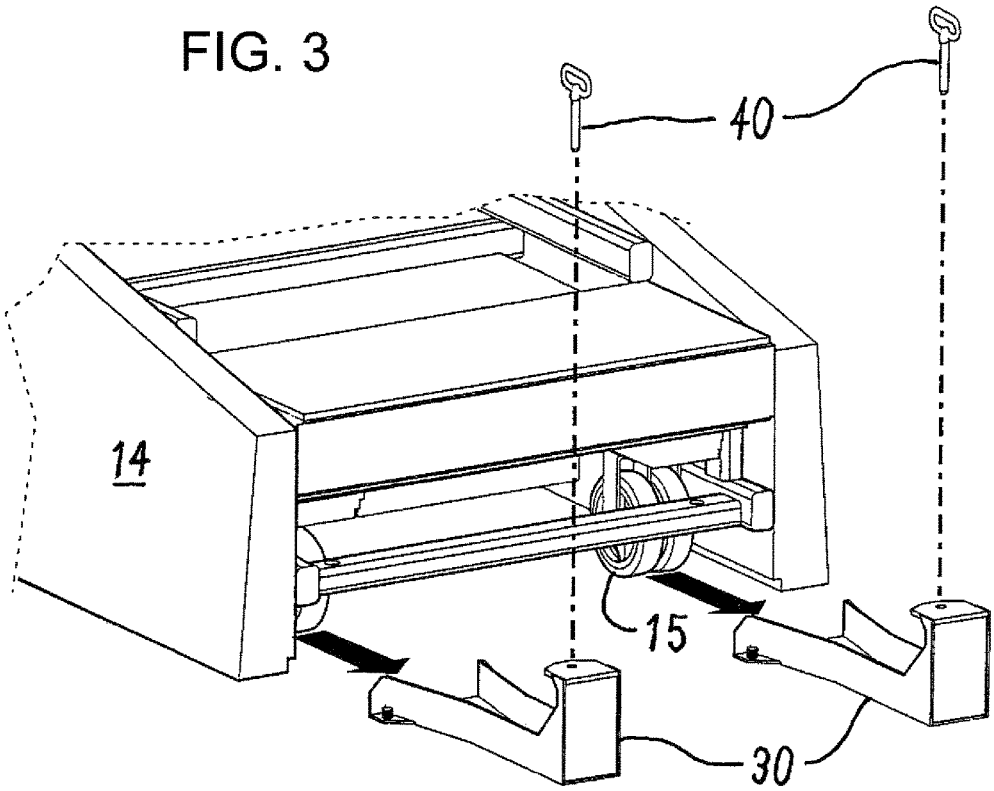
FIG. 3 is a detailed rear view of a basketball goal as the rear wheels enter the docking trays.
Figure 4:
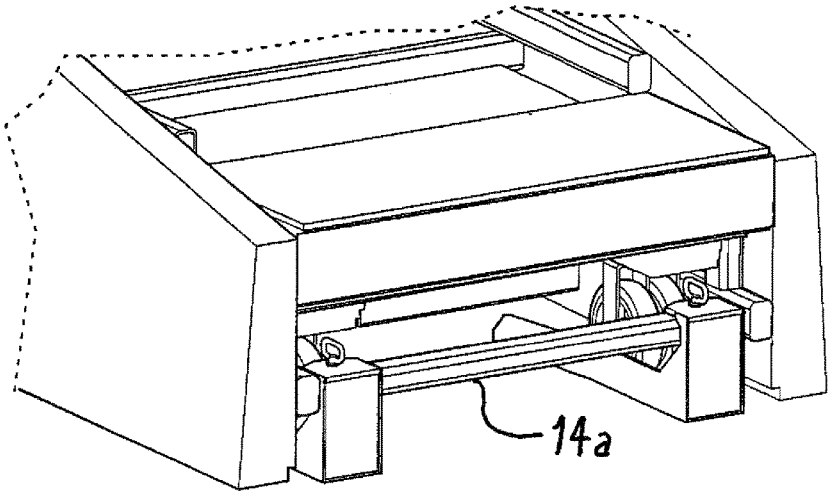
FIG. 4 is a detailed rear view of a basketball goal in its locking position in the docking trays.

Referring now to FIG. 3, the basketball goal is shown as its rear wheels enter the docking trays. The black arrows indicate the direction of movement of the basketball goal toward the docking trays. As the basketball goal is moved further to the rear, the rear wheels move from the wider portion of the docking trays to the narrower portions of the docking trays to place the goal in exactly the desired orientation on the basketball court. Referring now to FIG. 4, the drop pins are inserted through the holes in the overhanging ledges of the retainers and into mating recesses in the lower horizontal rear bar of the goal.

It can be appreciated that the only modification required of the court is the mounting of three small inserts per docking tray in the court. These inserts are flush or slightly recessed with the surface of the court and are located a considerable distance away from the playing area. When a movable basketball goal is to be placed on the court, the first step is to attach the two docking trays to the court using the thumbscrews. The basketball goal is then rolled into position with the rear wheels all the way into the docking trays. The drop pins are then inserted to engage the base of the goal, prevent forward movement of the goal, and anchor the goal to the floor for safe play. Positioning of the goal is thus accomplished without the use of any tools. The overhanging ledge prevents the goal from moving relative to the docking tray and the thumbscrews prevent the docking tray from moving relative to the court. The docking trays thus prevent any upward movement of the rear of the goal if a large downward force is applied at the front of the goal, as can occur during dunking of a basketball.

We claim:

1. A docking tray for receiving a basketball goal having a base with a rear wheel, the docking tray comprising:

(a) a flat base having an open front without a wall, a rear, and two sides, the front being wider than the rear and the two sides narrowing from front to rear;

(b) two side walls extending upwardly along the sides of the base;

(c) a rear wall extending upwardly along the rear of the base, the rear wall in combination with the base and the two side walls forming an enclosure with an open front for a rear wheel of a basketball goal;

(d) an elevated overhanging horizontal ledge extending from the rear wall toward the front, the ledge having a vertical hole; and (e) an unthreaded drop pin for insertion into the hole in the ledge for engaging and securing a base of a basketball goal.

2. The docking tray of claim 1 additionally comprising a means for attaching the docking tray to a floor.

3. The docking tray of claim 1 wherein the width of the front of the base is about one and one-half to three times the width of the rear of the base.

4. The docking tray of claim 1 additionally comprising a flange parallel to the base extending outwardly from each side wall, each flange having a hole for insertion of a fastener.

5. A basketball goal assembly comprising:

(a) a movable basketball goal comprising: (i) a backboard having a front and a rear; (ii) a rim connected to the front of the backboard; (iii) an arm connected to the rear of the backboard for elevating the backboard; (iv) a weighted base connected to the arm; and (v) two rear wheels for supporting the base; and (b) two docking trays for receiving and securing the basketball goal, each docking tray comprising: (i) a flat base having an open front without a wall, a rear, and two sides, the front being wider than the rear and the two sides narrowing from front to rear; (ii) two side walls extending upwardly along the sides of the base; (iii) a rear wall extending upwardly along the rear of the base, the rear wall in combination with the base and the two side walls forming an enclosure with an open front for a rear wheel of a basketball goal; (iv) an elevated overhanging horizontal ledge extending from the rear wall toward the front, the ledge having a vertical hole; and (v) an unthreaded drop pin for insertion into the hole in the ledge for engaging and securing a base of a basketball goal.

6. The basketball goal assembly of claim 5 wherein the base of the basketball goal comprises a lower horizontal rear bar with a vertical hole for accepting the unthreaded drop pin.

7. The basketball goal assembly of claim 5 wherein each docking tray additionally comprises a means for attaching the docking tray to a floor.

8. The basketball goal assembly of claim 5 wherein the width of the front of the base of each docking tray is about one and one-half to three times the width of the rear of the base.

9. The basketball goal assembly of claim 5 additionally comprising a flange parallel to the base extending outwardly from each side wall, each flange having a hole for insertion of a fastener.

10. A basketball goal assembly comprising:

(a) a movable basketball goal comprising: (i) a backboard having a front and a rear; (ii) a rim connected to the front of the backboard; (iii) an arm connected to the rear of the backboard for elevating the backboard; (iv) a weighted base connected to the arm; and (v) two rear wheels for supporting the base;

(b) two docking trays for receiving and securing the basketball goal, each docking tray comprising: (i) a flat base having an open front without a wall, a rear, and two sides, the front being wider than the rear and the two sides narrowing from front to rear; (ii) two side walls extending upwardly along the sides of the base; (iii) a rear wall extending upwardly along the rear of the base, the rear wall in combination with the base and the two side walls forming an enclosure with an open front for a rear wheel of a basketball goal; and (iv) an elevated overhanging horizontal ledge extending from the rear wall toward the front, the ledge having a vertical hole; and (v) an unthreaded drop pin for insertion into the hole in the ledge for engaging and securing a base of a basketball goal; and (c) a plurality of receivers for mounting into a floor and for receiving a plurality of fasteners passing through each docking tray.

11. The basketball goal assembly of claim 10 the base of the basketball goal comprises a lower horizontal rear bar with a vertical hole for accepting the unthreaded drop pin.

12. The basketball goal assembly of claim 10 wherein each docking tray additionally comprises a plurality of fasteners for attaching the docking tray to a floor and for attaching the goal to the docking tray.

13. The basketball goal assembly of claim 10 wherein the width of the front of the base of each docking tray is about one and one-half to three times the width of the rear of the base.

14. The basketball goal assembly of claim 10 wherein each docking tray additionally comprises a flange parallel to the base extending outwardly from each side wall, each flange having a hole for insertion of a fastener.

* * * * *